United States Patent [19]

Holmes

[11] Patent Number: 4,999,969

[45] Date of Patent: Mar. 19, 1991

[54] BAG CLOSING APPARATUS

[75] Inventor: Jack H. Holmes, Cowiche, Wash.

[73] Assignee: Kwik Lok Corporation, Yakima, Wash.

[21] Appl. No.: 467,059

[22] Filed: Jan. 18, 1990

[51] Int. Cl.[5] ..... B65B 7/02; B65B 7/12; B65B 51/04

[52] U.S. Cl. ..... 53/138.3

[58] Field of Search ..... 53/138 A, 138 R, 583, 53/217, 370; 29/243.5, 243.56, 243.57; 140/93 A, 93 D

[56] References Cited

U.S. PATENT DOCUMENTS

| | | | |
|---|---|---|---|
| 385,083 | 6/1888 | Yund . | |
| 819,466 | 5/1906 | Staude . | |
| 997,145 | 7/1911 | Lines . | |
| 1,569,554 | 1/1926 | Lissner . | |
| 1,800,657 | 4/1931 | Pelletier . | |
| 2,082,577 | 6/1937 | Herschmann . | |
| 2,636,297 | 4/1953 | Johnson . | |
| 2,705,100 | 3/1955 | Paxton et al. . | |
| 2,760,701 | 8/1956 | Phelps . | |
| 2,855,647 | 10/1958 | Smith . | |
| 2,937,464 | 5/1960 | Marshall . | |
| 2,981,990 | 5/1961 | Balderree . | |
| 3,022,571 | 2/1962 | Niedecker . | |
| 3,061,983 | 11/1962 | Irwin . | |
| 3,099,116 | 7/1963 | Platt et al. | 53/138 A |
| 3,163,969 | 1/1965 | Irwin et al. | 53/138 A |
| 3,163,970 | 1/1965 | Paxton . | |
| 3,163,972 | 1/1965 | Irwin | 53/138 A |
| 3,164,249 | 1/1965 | Paxton . | |
| 3,164,250 | 1/1965 | Paxton . | |
| 3,190,053 | 6/1965 | Tobey | 53/138 A |
| 3,264,698 | 8/1966 | Wright . | |
| 3,270,481 | 9/1966 | Rocholl . | |
| 3,270,872 | 9/1966 | Paxton . | |
| 3,270,874 | 9/1966 | Hilton . | |
| 3,370,396 | 2/1968 | Paxton et al. . | |
| 3,621,632 | 11/1971 | Browning | 53/138 A |
| 3,668,818 | 6/1972 | Holmes . | |
| 3,822,441 | 7/1974 | Hilton . | |
| 3,983,681 | 10/1976 | Britt et al. | 53/138 A X |
| 4,026,413 | 5/1977 | Britt et al. . | |
| 4,077,187 | 3/1978 | Paxton . | |
| 4,171,602 | 10/1979 | Richardson . | |
| 4,215,606 | 8/1980 | Britt . | |
| 4,242,171 | 12/1980 | Kauer et al. . | |
| 4,333,566 | 6/1982 | Holmes . | |
| 4,335,490 | 6/1982 | Teachout . | |
| 4,357,740 | 11/1982 | Brown . | |
| 4,509,231 | 4/1985 | Paxton . | |

FOREIGN PATENT DOCUMENTS

| | | |
|---|---|---|
| 596311 | 7/1959 | Italy . |
| 883771 | 12/1961 | United Kingdom . |

OTHER PUBLICATIONS

Three Illustrations–"Instruction Manual for the Type 1087A Fixed Speed & Type 1087AV Variable Speed Automatic Bag Closing Machine," Jun. 1988, pp. 3–4, 21–22, 47–48.

*Primary Examiner*—Robert L. Spruill
*Assistant Examiner*—Daniel Moon
*Attorney, Agent, or Firm*—Seed and Berry

[57] ABSTRACT

An idler rim is freely rotatably mounted adjacent the first closing ring of a bag closing device. In one embodiment, an idler rim is also placed on a pinch roller that engages the closing ring. These idler rims allow the package to be brought laterally more closely to the closing station so that the closure can be placed more tightly on the end of the package. There also is provided a bracket for mounting the entire bag closing device so that the closing device can be adjusted pivotally and linearly toward the conveyor.

14 Claims, 3 Drawing Sheets

BAG CLOSING APPARATUS

TECHNICAL FIELD

This invention pertains to bag closing apparatus of the type utilized when closing flexible materials such as plastic film bags with a closure.

DESCRIPTION OF THE PRIOR ART

Bag or package closing apparatus of the type particularly well suited for handling plastic film bags, such as for bread bags and the like, are well known. U.S. Pat. No. 3,163,972 shows a typical bag closing apparatus for this purpose. A bag closing apparatus will include a horizontal conveyor for supporting bags filled with a product and a tensioning device such as opposed sets of brushes for pulling the end of the bag, known as the tail, toward the one side of the conveyor. The conveyor will have some form of a barrier or fence to block movement beyond the side of the conveyor of the body portion of the bag which holds the product, such as a loaf of bread, but allows the tail to be flattened and spread out to its approximate full width by the brushes in the bag tensioning device. The bag closing apparatus further includes a bag closing device downstream on the conveyor, where the tail of the bag is fed between forward and rearward closing rings of a closing roll assembly on the bottom and a spaced pressure roll and a rearward bogie belt on the top, respectively. Adjacent the nip between the two closing rings and the respective pressure roll and bogie belt will be positioned a plastic closure. The closing device will then further tension the tail of the bag and feed the leading edge of the tail into the bag neck receiving opening of the closure until all of the tail is gathered into the bag neck receiving opening of the closure. The closure is then removed with the bag held with its tail tightly closed. The location on the tail at which the closure is located is defined as the bag neck.

The products that are packaged in bags are of varying compressibilities. A soft, light and airy bread, for example, will tend to compress while passing through the closing apparatus. A more dense, firmer bread will not undergo as much compression. Another variable factor in bag closing is the width of the bag and the size of the product, which will vary depending upon the product that is being packaged. Still another variable factor is the slipperiness of the plastic bag film. These variables in the type of product, the size of the package, the width of the bag, and the slipperiness of the two layers of the plastic bag tail make consistent and uniform closing of bags difficult. In addition, the package is most acceptable when the bag neck, with the closure, is pulled up tightly against the product so that the product is held firmly by the tension in the bag body.

To be able to accommodate the above variables, the closing roll assembly is angularly adjustably positioned relative to the conveyor surface such that a vertical plane parallel to the rings can be adjusted between a shallow angle through a steeper angle with the vertex of the angle downstream in the direction of conveyor movement.

The adjustment of the closing roll assembly also is useful for positioning the closure centrally on the tail of the package relative to the longitudinal axis of the package. That is, it is desirable to place the closure tightly against the body but along the central axis of the body of the bag. This means that the leading edge of the tail will be approximately the same length from the body to the closure as the trailing edge of the tail.

Some conveyors will have flights to push the bag the spacing of which can be adjusted. These flights are positioned greater than the width of the bag to be handled. For example, an 8-inch wide bag will generally require a 9.6 inch flight space, whereas a 12-inch flight space may be more suitable for a 10-inch wide bag.

Due to the dynamics of package handling, it is generally considered that 100 feet per minute is a practical limit for a flighted conveyor speed. A closing roll assembly speed, by contrast, will be approximately 500 feet per minute because of the low recycling speed efficiency. This maximum linear peripheral closing roll assembly speed of approximately 500 feet per minute is considerably faster than the conveyor speed. This disadvantageously requires the closing rings to gather the tail of the bag by accelerating the tail slightly ahead of the bag itself, causing the bag to rotate with its opposite end still moving with the conveyor flight.

Heretofore, it was difficult with some bags to obtain a tight package because there was too much loose film or tail between the product and the closure. If the product was highly compressible, the tail could be pulled more tightly by the bag tensioning device and the compressibility of the product would allow the product to spring back after it was closed, causing a tight package. However, this technique for producing a tight package was not available for more dense products which were less compressible. Thus, it is important to develop a closing apparatus which will allow the closure to be placed closer to the body of the bag and thus the product, without having to elastically compress the product to obtain this closeness. This was difficult in prior closing apparatus, because the barriers or fences designed to prevent the bag body from being drawn too far into the closing device created a large space between the body and the closure. It is also desirable to reduce rubbing of the film against the spinning front closing ring rim which may burn a hole and effect the shelf life of the product or mark the film and affect its appearance.

SUMMARY OF THE INVENTION

This invention pertains to several features of a bag closing apparatus which enhance the tightness of the package and reduce the chance of marking or burning the film of the package by the closing device. Basically, the invention includes an idler rim or disc placed next to the forward closing ring of the closing roll assembly that is exposed to the body of the bag to provide the barrier against further movement of the body of the bag into the closing device. By placing the idler rim directly on or adjacent the forward closing ring, the space between the closing ring and the body of the bag is brought to a minimum so that the closure can be placed on the bag neck closely adjacent to the body and thus the product in the body. In one embodiment, the idler rim is of a material of low friction and is relatively rigid so that the film can slide easily over the peripheral edge of the idler rim and not deflect the rim. The idler rim is of a diameter slightly greater than the diameter of the forward closing ring. This greater diameter guides the film onto the friction rim of the forward closing ring without subjecting the film to the edges or sides of the closing ring and reduces the chance of burning or marring of the film. The idler rim is freely rotatable relative to the closing ring so that as the package hits the idler rim, it can drive the idler rim to a tangential speed the same as the linear speed of the package. This ability to have the film of the package hit and drive the idler rim reduces the opportunity for the spinning forward closing ring to burn or cut holes in the plastic material.

In addition to the idler rim, the closing apparatus is also provided with a mounting bracket assembly which allows the vertical plane of the closing roll assembly to be positioned at various angles relative to the conveyor and to be moved linearly in and out toward the conveyor for different angle positions. These adjustments can be made easily by the operator to accommodate various film thicknesses and widths of bag tails that are being handled. The entire closing device, in combination with the idler rim and mounting bracket assembly, is now more variable for better adjustment of the angles and spacing relative to the conveyor than in the prior art, so that more flexibility is given to the operator of the equipment to produce a tighter, more centralized closure on the neck of the bag without marking or burning a hole in the bag.

DETAILED DESCRIPTION OF THE INVENTION

Figure 1:
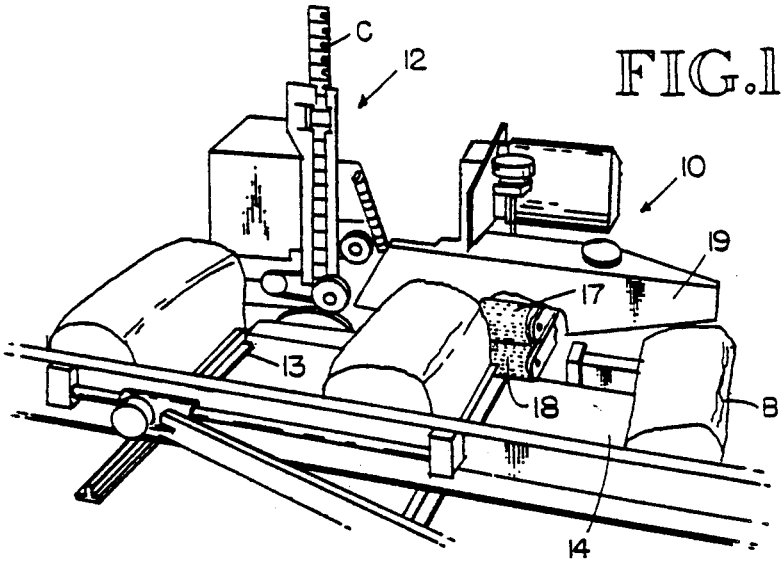
FIG. 1 is a schematic perspective of the bag closing apparatus embodying the invention.

A mechanical bag closing apparatus of the type that puts a closure on the neck of a bag is shown in U.S. Pat. No. 3,163,972, the details of which are incorporated herein by specific reference thereto.

This type of closing apparatus has an operating cycle efficiency of approximately 30%. This means that 30% of the cycle time is used for inserting the bag tail into the closure aperture and 70% is used for recycling. A bag closing apparatus consists of a conveyor 14, a tensioner 10, and a closing device 12. The conveyor generally has a plurality of flights 13 on a belt to space and carry the package through the closing apparatus. The flights are spaced approximately 20% more than the lay flat width of the bag B.

The bag or package B containing a product P is conveyed down the conveyor through the bag tensioning device and through the bag closing device. The bag lies across the conveyor laterally with a surplus of bag film, known as a tail 15, extending out from one end of the bag beyond the conveyor. This excess film or tail is required for insertion into the closure C. The area of the tail, which gets compressed and inserted into the closure, will be called the bag neck. The bag tail slides on a support rail 16 on the side of the conveyor ahead of and along the bag tensioning device 10.

As described earlier, the bag tensioning device 10 is made up of a set of opposing, horizontally rotating brushes 17, 18, lying in a vertical plane, at a slight angle to the conveyor. The vertex of the angle of the plane of the brushes is pointing downstream in the direction of conveyor flow F. These brushes can be adjusted together vertically in relation to each other for applying a varying friction pull force on the bag tail. This pull is in the direction of the brush rotation, or longitudinally of the package as the bag tail passes between the brushes laterally. This pulling force will align the product longitudinally and uniformly against barriers or fences 16 and 19 in front of the brushes. The angle at which the vertical plane of the brushes is adjusted provides a component of the pulling force which is in the direction of conveyor flow. This helps to move the bag tail through the brushes.

Figure 4:
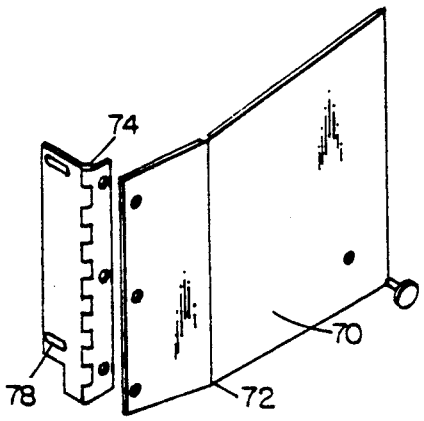
FIG. 4 is a schematic exploded view of the bag closing device shown in FIG. 3.

The bag closing device 12 includes a pressure roll assembly 20 and a closing roll assembly 22 (FIG. 4). The closing roll assembly is made up of two parallel rings consisting of a forward ring 24 and a rearward ring 26. These rings are approximately 5 inches in diameter and are spaced approximately 13/16 inches apart. Belts or other rolls may also be used.

Figure 3:
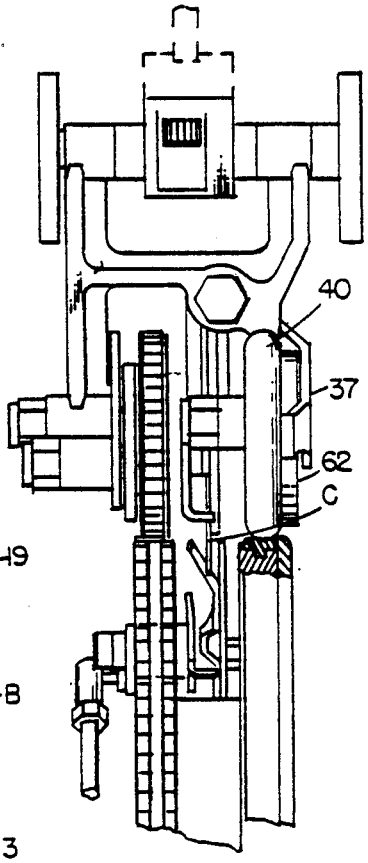
FIG. 3 is a fragmentary end view looking in from the left in FIG. 2.
Figure 3A:
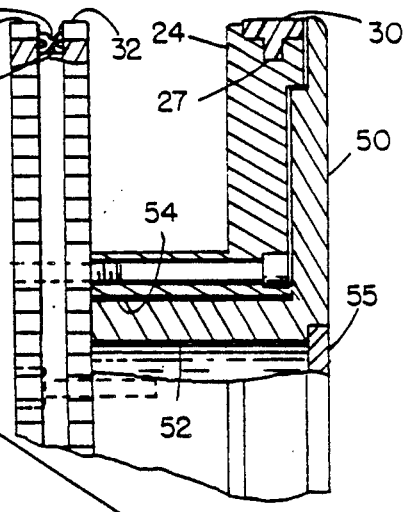
FIG. 3A is an enlarged detail of the closing roll assembly.
Figure 3A:
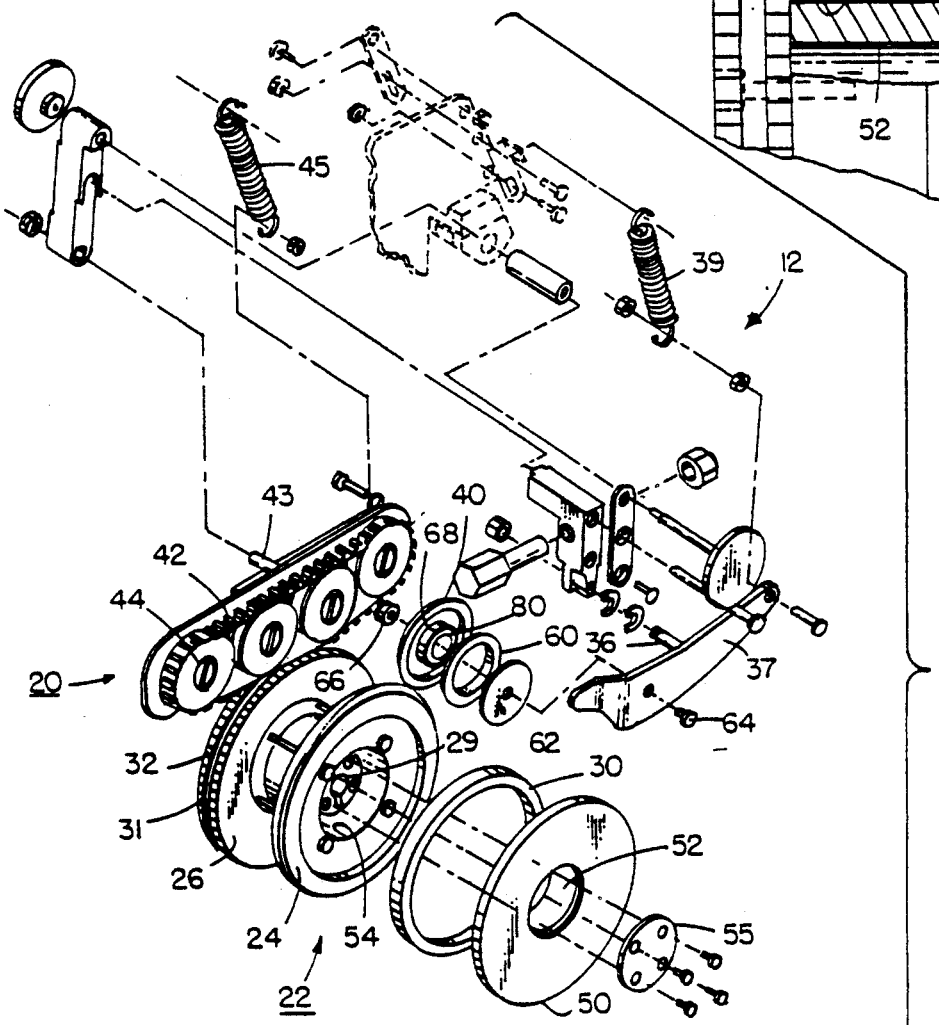

The forward ring (closest to the conveyor 14) is a metal disc or pulley having a T-shaped peripheral slot 27 (FIG. 3A). A T-shaped rubber friction band or tire 30 is fitted in the slot.

The rearward ring 26 (FIG. 4) similarly is provided with a peripheral slot 31, but is provided with toothed or gear friction rims 32.

These forward and rearward rings are bolted together to form the closing roll assembly and are driven by a shaft (not shown) keyed in the hub 29 to the rearward ring to drive the rings at the same rotational speed.

The pressure roll assembly 20 includes a freely rotatable metal pressure roll 40. The pressure roll is mounted on an adjustable pressure bar 37 and is biased toward and into contact with the outer closing roll tire 30 by a spring 39 which pivots the bar about a pivot 36.

A toothed rubber bogie belt 42 is mounted on a series of freely rotatable bogie support rollers 44. The belt is pivoted about a pivot 43 by a spring 45 against the rims of the rearward closing ring 26. The toothed configuration of the bogie belt and the gear rims on the rearward ring is such as to grip the plastic film better by mechanical action as well as through friction.

An X-shaped rubber "quad" tire 79 is placed in the groove 31 between the two gear rims 32. This rubber tire applies friction on the bag tail film as the gear bogie belt teeth ride on it. As the meshing gear belt and ring drive the bag tail film tangentially, the rubber "quad" tire 79 keeps the bag neck from slipping axially through the teeth due to tension buildup longitudinally on the bag tail.

Figure 5C:
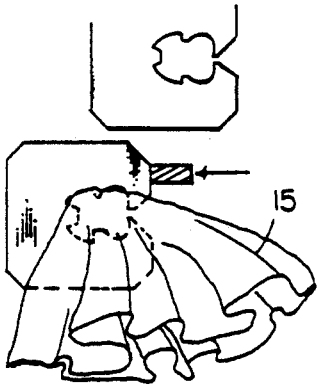
FIGS. 5A, 5B and 5C are schematic operational views.
Figure 5B:
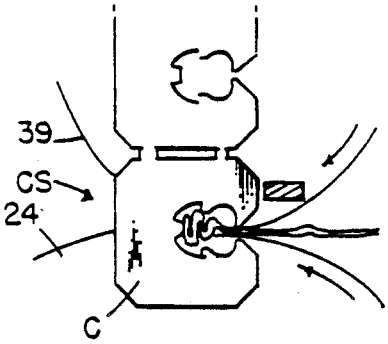
Figure 5A:
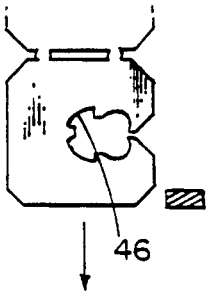

The initial point of contact between the pressure roll and the bogie belt and their respective closing roll rings is termed "the pinch point." Spaced in a vertical plane between the two rings is a closing station CS in which is positioned a closure C of the type shown, for example, in U.S. Pat. No. 3,163,972. Each closure has a bag neck receiving opening 46 (FIG. 5A) into which the bag neck of the tail is gathered and held compressed in a tight-gripping configuration.

It is a unique feature of this invention that the forward closing ring 24 is provided with an idler rim or disc 50, the diameter of which is slightly greater than the diameter of the closing ring. The idler rim is freely rotatable relative to the forward closing ring and is made of low friction but rigid material (such as Nylatron) so as to let the bag tail slide readily over the idler rim and into contact at the pinch point with the friction tire 30 of the closing ring and the pressure roll. The idler rim is rotably mounted to the hub 29 by a flange 52 that fits in a cup-shaped recess 54 on the closing ring. A retainer disc 55 is bolted to the hub 29 and holds the idler disc on the ring in a freely rotating manner.

The pressure roll 40 may also be provided with another low friction rigid idler rim or disc 60 which is also freely rotatably mounted onto the pressure roll and held in place by a retainer disc 62. The retainer disc supports the outer end of the pressure roll bearing 80 by a bolt 64 threaded into a bushing 66. The idler rim 60 mounts on a cup-shaped flange 68 on the pressure roll with the bushing supporting the inner end of the pressure roll bearing. The retainer disc mounts against the pressure roll bearing so that the idler rim can rotate freely relative to the pressure roll. The idler rim 60 is of a diameter slightly less than the diameter of the pressure roll because of the tendency of the spring loaded pressure roll to sink into the rubber tire 30.

Figure 2:
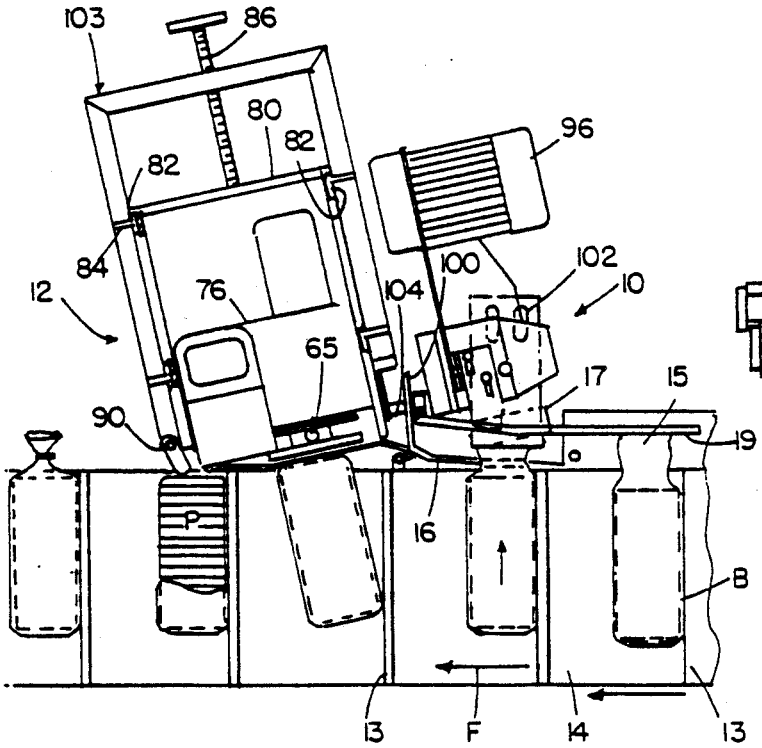
FIG. 2 is a plan view with parts of the closing device removed for clarity.

Also, to enable the body of the bag to be moved more closely to the bag closing station, the protective cover 70 enclosing the conveyor side of the closing roll assembly 22 is trimmed down even with the center of the closing roll assembly, exposing the upper half of the closing roll assembly. The body of the bag can now be pulled up against the idler rim or disc. This cover is hinged as at 74 and is slidably adjustably bolted on a housing 76 (FIG. 2) through slots 78 on the hinge.

The housing 76 (FIG. 2) mounts the pressure roll assembly and the closing roll assembly and is itself mounted in a generally inverted U-shaped bracket 80. The bracket is provided with guideways 82 in which are slidably mounted rollers 84 that are fixed to another U-shaped frame assembly 103 which loosely fits around the U-bracket 80. A threaded adjustment shaft 86 is rotatably attached to the U-shaped bracket 80 and threads through the U-shaped frame assembly 103 so that the position of the housing can be moved linearly toward and away from the conveyor.

The U-shaped frame assembly 103 is also pivotally mounted to the conveyor by a pivot post 90 that is secured to the conveyor frame. By pivoting the bracket, the vertical plane of the closing rolls can be angled toward or away from the conveyor to change the angle. The bag support rail 16 guides the bag into the pinch point between the pressure roll assemblies and the closure roll assembly. The angle of the U-shaped frame assembly, and thus the plane of the closing rolls, is fixed or set by an adjustment bracket 100 having openings for locking into various positions by an adjustment post 104. This adjustment post is connected to the housing 76 and can be released and reset in various positions along the bracket 100 in any suitable manner.

The bag tensioning device 10 includes the spaced brushes 17 and 18. These brushes are rotated simultaneously in counter-rotating directions by a motor 96. The brushes are adjustably positioned by slots 102 for changing the location of the brushes toward and away from the conveyor.

FIGS. 5A–5C and FIG. 2 show a simplified summary of the action of the package moving through the bag closing device. The bag B has a tail 15 joining the body that holds the product P. The package is generally pushed through the closing system by the flight bars 13 of the conveyor belt 14. The bag tail passes through the brushes 17 and 18 of the tensioner and is drawn up against and under the fence 19 and up against and over the rail 16. As the package gets mostly through the brushes, it enters the pinch point between the closing roll assembly 22 (FIG. 4) and the pressure roll assembly 20 of the bag closure device 12. The bag tail of the package is immediately, and rapidly, drawn laterally relative to the bag ahead of the flight bar. This causes the package to assume an angle to the flight bar with the opposite end of the package still against the flight bar. By the time the cycle is complete, the flight bar will have caught up with the package.

The instant the bag tail enters the closing pinch point, the package is pulled longitudinally of the bag toward the closure C as the bag neck film is gathered around the end of the package, and into the closure bag neck receiving opening. This longitudinal distance is approximately equal to one half of the horizontal width of the package. It represents the amount of film required to wrap around the end of the product from the leading edge, or trailing edge, of the tail to where the closure is applied in the center of the package.

The nature of this closing action on the bag causes the forward closing ring 24 to track across the bag neck in the form of a convex arc. Therefore, to obtain proper closing, the closing device is hinged so that it can be angled out from the side of the conveyor. The angle should be such that the closing ring tracking arc is symmetrical to the end of the product in the bag. In other words, the distance from the end of the product to the pressure roll assembly pinch point must be the same at the leading edge of the tail as it is with the trailing edge of the tail or it must be the same at the end of closing as it was at the beginning of closing. If the closing device angle is less than it should be for the package width, it will dive into the trailing corner of the tail and mark or tear the bag. If it is at a greater angle than it should be for the bag width, the package will be loose.

The floating idler rim 50, since it is of a diameter slightly larger than the diameter of the closing ring tire 30 will receive the film from the fence and will guide the tail directly into the pinch point of the spinning rubber friction rim 30 and pressure roller. In this manner, the tension on the tail developed by the closing forces will be carried by the idler rim at the speed of the film without burning, and the film will be less likely to be damaged. The idler rim eliminates the necessity of a fixed rod fence to support the film across the front of the prior spinning closing roll design, thereby directly reducing the distance from the fenced end of the package and the closure. Since the idler rim turns with the film flow, it also advantageously eliminates the drag created by the prior fence heretofore used.

Another important, unique feature is that the idler rim now becomes the fencing means for the package, and it will be moved also as the closing angle changes, eliminating one of the tightness variables.

With the addition of the linear in and out adjustable U-frame assembly, another unique feature is gained which was not available with the prior designs. With the fixed fence 16, any change in angle of the closing roll assembly will vary the pinch point position relative to the end of the package. This directly changes the package tightness. Now, with the linear in and out adjustment, if the vertical plane through and parallel to the closing face is angled out, the pinch point can be adjusted forward to the same position it was by use of the adjustment screw 86. Now the angle can be set at the best position for the bag width, and the screw 86 can be used to obtain the proper tightness.

I claim:

1. A bag closing apparatus for placing a closure on the neck of a bag close to the product in the bag, the bag including a tail and a body joined to the tail, said body holding the product, comprising:

a conveyor having a horizontal bag support surface for moving a bag holding a product along a bag closing path;

means for pulling the tail of the bag laterally of the conveyor across the bag closing path;

first barrier means along the conveyor for impeding the body of the bag from crossing the bag closing path;

closure applying means including:

a pair of forward and rearward closing rings along the bag closing path at a closing station, each closing ring having a peripheral friction surface;

pinching means biased against the forward and rearward closing rings, one of said forward closing rings and pinching means being driven for pulling the bag through the closing station, one of said rearward closing rings and pinching means being driven for pulling the bag through the closing station and for maintaining tension of the film across the closing path and between closing rings;

a closure at the closing station for receiving the tail of the bag and tightly encircling the bag tail as the bag is pulled between the closing rings and the pinching means; and idler second barrier means mounted on said forward closing ring for blocking the movement of said bag body across the bag closing path but allowing the bag body to be pulled tightly up to the forward bag closing ring to reduce the space between the closure and the product being held in the bag body.

2. The bag closing apparatus of claim 1, said idler second barrier means including a low friction disc, freely rotatably mounted on said forward closing ring, whereby the bag body is pulled against the disc for stopping movement of the body.

3. The bag closing apparatus of claim 2, said disc having a diameter slightly larger than the diameter of the forward closing ring so that the bag tail is guided over the circumference of the disc onto the friction surface of the spinning closing ring at the pinch point with the pinching means.

4. The bag closing apparatus of claim 1, said pinching means including a freely rotating pressure roll, engageable with said forward closing ring and an elongated traction belt engageable with said rearward closing ring.

5. The bag closing apparatus of claim 1, including:

mounting means for mounting the closure applying means adjacent the conveyor, said closure applying means including a housing slidably adjustably mounted in said mounting means for movement toward and away from said conveyor, and means pivotally supporting the mounting means adjacent the conveyor whereby the closure applying means is both adjustable linearly and pivotally relative to the conveyor for changing the angle of the closing ring and pinching means relative to the conveyor and the distance between the forward closing ring and its pinching means relative to the conveyor.

6. The apparatus of claim 3, including:

mounting means for mounting the closure applying means adjacent the conveyor, said closure applying means including a housing slidably adjustably mounted in said mounting means for movement toward and away from said conveyor, and means pivotally supporting the mounting means adjacent the conveyor whereby the closure applying means is both adjustable linearly and pivotally relative to the conveyor for changing the angle of the closing rings and pinching means relative to the conveyor and the distance between the closing rings and pinching means relative to the conveyor.

7. Bag closure applying means for use in a bag closing apparatus having a conveyor for carrying bags of product along a bag closing path through a bag closing station with the bags each having a tail and a product holding body, the improvement comprising:

first and second rotatable bag closing rings spaced on opposite sides of a bag closing path;

first and second bag tail pinching means respectively engaging the first and second closing rings for pulling a bag tail along said closing path;

said first closing ring being closer to said bag body than said second closing ring;

an idler disc freely rotatably mounted on said first closing ring toward said bag body;

means for driving said closing rings for pulling a bag in a first direction transversely of the bag through said bag closing station and in a second direction longitudinally of the bag toward said first closing ring and said idler disc whereby a bag body with the product will be pulled against the idler disc in the second direction but the tail can slide freely over the periphery of the idler disc in the first and second direction past the first closing ring.

8. The bag closure applying means of claim 7, including a housing for rotatably supporting the first and second closing rings and the first and second bag tail pinching means, first mounting means for mounting said housing for pivotal movement about a vertical axis and second mounting means for mounting said housing for linear horizontal movement.

9. The bag closure applying apparatus of claim 7, said first bag tail pinching means including a freely rotatable pressure roll biased against said first closing ring, said second bag tail pinching means including an elongated traction belt biased against said second closing ring.

10. The bag closure applying apparatus of claim 7, said idler disc having a diameter slightly larger than said first closing ring.

11. A bag closing apparatus for placing a closure on the neck of a bag of the type having a tail and a body holding a product;

a conveyor having a horizontal bag carrying surface and a plurality of flights for moving filled bags along a bag closure applying path;

a barrier alongside of the conveyor;

a plurality of rotating brushes for pulling the tail of the bag across the bag closure applying path;

a rail for supporting the tail alongside of the conveyor;

a first rotatably driven closing ring and a pinch roll adjacent the conveyor;

a second rotatably driven closing ring and a pinch belt spaced further from said conveyor but generally axially aligned with said first closing ring and pinch roll; and an idler disc freely rotatably mounted on said first closing ring for guiding the tail onto said first closing ring.

12. The bag closing apparatus of claim 11, said idler disc having a diameter greater than the diameter of said first closing ring.

13. A bag closing apparatus for placing a closure on the neck of a bag close to the product in the bag, the bag including a tail and a body joined to the tail, said body holding the product, comprising:

a conveyor having a horizontal bag support surface for moving a bag holding a product along a bag closing path;

means for pulling the tail of the bag laterally of the conveyor across the bag closing path;

barrier means along the conveyor for impeding the body of the bag from crossing the bag closing path;

closure applying means including:

a pair of forward and rearward closing rings along the bag closing path at a closing station, each closing ring having a peripheral friction surface;

pinching means biased against the forward and rearward closing rings, one of said forward closing rings and pinching means being driven for pulling the bag through the closing station, one of said rearward closing rings and pinching means being driven for pulling the bag through the closing station and for maintaining tension of the film across the closing path and between closing rings;

a closure at the closing station for receiving the tail of the bag and tightly encircling the bag tail as the bag is pulled between the closing rings and the pinching means; and mounting means for mounting the closure applying means adjacent the conveyor, said closure applying means including a housing slidably adjustably mounted in said mounting means for movement toward and away from said conveyor, and means pivotally supporting the mounting means adjacent the conveyor whereby the closure applying means is both adjustable linearly and pivotally relative to the conveyor for changing the angle of the closing ring and pinching means relative to the conveyor and the distance between the forward closing ring and its pinching means relative to the conveyor.

14. The bag closing apparatus of claim 13, said mounting means including a U-shaped frame assembly; bracket means movably mounted on said U-shaped frame assembly for movement toward and away from said conveyor, and means pivotally adjustably mounting said U-shaped frame assembly to said conveyor.

* * * * *